US006481240B2

(12) United States Patent
Strikis et al.

(10) Patent No.: US 6,481,240 B2
(45) Date of Patent: Nov. 19, 2002

(54) OIL SEPARATOR

(75) Inventors: Guntis Viktors Strikis, Belleville, MI (US); Kanwal Bhatia, Troy, MI (US); Lavlesh Sud, Farmington Hills, MI (US); Mirza Qadir Mahmood Baig, Inkster, MI (US); Vipen Khetarpal, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/775,283

(22) Filed: Feb. 1, 2001

(65) Prior Publication Data

US 2002/0100291 A1 Aug. 1, 2002

(51) Int. Cl.[7] ..... F25B 43/02
(52) U.S. Cl. ..... 62/470; 417/313
(58) Field of Search ..... 62/470; 417/292.2, 417/313; 55/459.1; 210/512.1

(56) References Cited

U.S. PATENT DOCUMENTS 3,504,804 A * 4/1970 Newman et al. ..... 210/512
4,255,099 A 3/1981 Komori
4,996,841 A 3/1991 Meijer et al.
5,159,820 A 11/1992 Oshishi et al.
5,565,101 A * 10/1996 Kuntz ..... 210/512.1
5,636,974 A 6/1997 Ikeda et al.
5,718,566 A * 2/1998 Ikeda et al. ..... 417/269
5,795,139 A * 8/1998 IKeda et al. ..... 62/470
5,816,134 A 10/1998 Takenaka et al.
5,921,756 A 7/1999 Matsuda et al.
6,010,320 A 1/2000 Kwon
6,015,269 A * 1/2000 Ota et al. ..... 417/222.2
6,129,775 A * 10/2000 Conrado et al. ..... 55/459.1
6,134,898 A * 10/2000 Umemura et al. ..... 62/470

FOREIGN PATENT DOCUMENTS

JP 05180539 A * 7/1993 ..... 62/470
JP 405296611 A * 11/1993 ..... 62/470

* cited by examiner

*Primary Examiner*—William E. Tapolcai
*Assistant Examiner*—Mohammad M. Ali
(74) *Attorney, Agent, or Firm*—Brinks Hofer Gilson & Lione

(57) ABSTRACT

An oil separator comprising a cylindrical portion, an inlet for incoming gas/oil mixture, an outlet for separated gas, a lower portion, and an outlet for separated oil is provided. The lower portion decreases in diameter as it proceeds from top to bottom, thereby providing for an increase in centrifugal force within the oil separator and greater separation of oil.

8 Claims, 4 Drawing Sheets

OIL SEPARATOR

FIELD OF THE INVENTION

The present invention relates to an oil separator that separates suspended oil from a gaseous medium. More specifically, the invention relates to an oil separator that achieves oil separation via an increasing centrifugal force.

BACKGROUND OF THE INVENTION

In compressors typically used in refrigeration and air conditioning systems, such as swashplate type compressors, a mist containing lubricating oil suspended in the gaseous refrigerant medium is often discharged from the compressor. That is, the high pressure refrigerant expelled by operation of the compressor frequently comprises a mist containing droplets of oil used to lubricate the moving parts of the compressor. Due to differences in various physical properties between the oil and the refrigerant, any oil that remains suspended in the refrigerant as it travels throughout the refrigeration circuit can reduce the performance of the compressor and refrigeration system. For example, by reducing oil available to the moving parts of the compressor, the compressor is susceptible to increased wear and seizure potential. Also, oil deposits on heat exchangers can reduce their efficiency.

To combat these problems, an oil separator can be added to the refrigeration circuit, and is typically positioned between the compressor outlet and condenser inlet. The oil separator functions to separate the suspended oil from the gaseous refrigerant. Several designs have been proposed for such oil separators. For example, U.S. Pat. No. 5,159,820 to Ohishi et al. for an "OIL SEPARATOR INTEGRALLY MOUNTED ON COMPRESSOR", hereby incorporated by reference in its entirety, discloses an oil separator that utilizes centrifugal force on the mixture to separate the oil from the refrigerant. The oil separator of the '820 patent comprises a body for forming an oil separating chamber and an oil storage chamber. A separating plate divides the two chambers and an inlet passage is tangentially connected to the oil separating chamber and travels toward the separating plate. A medium outlet passage extends inwardly into the oil separating chamber, and an oil outlet passage is provided in the separating plate.

Considering the potential effects of oil being gradually removed from the compressor due to its suspension in the refrigerant output, there is a need to improve the state of the oil compressor art.

SUMMARY OF THE INVENTION

The present invention provides an oil separator that comprises a cylindrical portion, a tangentially connected inlet passage, a refrigerant outlet passage having an inner opening optimally positioned within the interior of the oil separator, a lower portion, and an oil outlet. The lower portion provides a cross-sectional diameter that decreases as the lower portion proceeds from top to bottom. Also, the present invention provides a swashplate type compressor that includes such an oil separator.

DETAILED DESCRIPTION OF PREFERRED AND ALTERNATE EMBODIMENTS

The following description of a preferred embodiment and two alternate embodiments provides a detailed description of the invention. The embodiments discussed herein are exemplary in nature, and are not intended to limit the scope of the invention in any manner.

Figure 1:
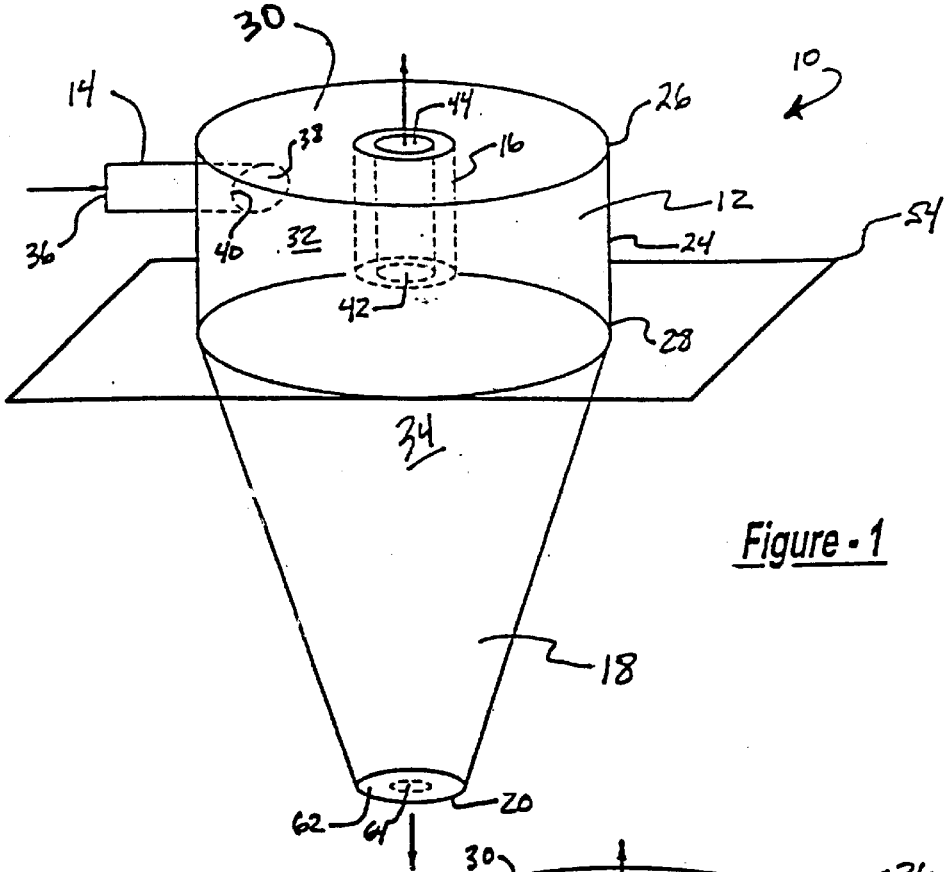
FIG. 1 is a schematic of a preferred embodiment of an oil separator in accordance with the present invention. The figure highlights a plane that encompasses components of the oil separator.
Figure 2:
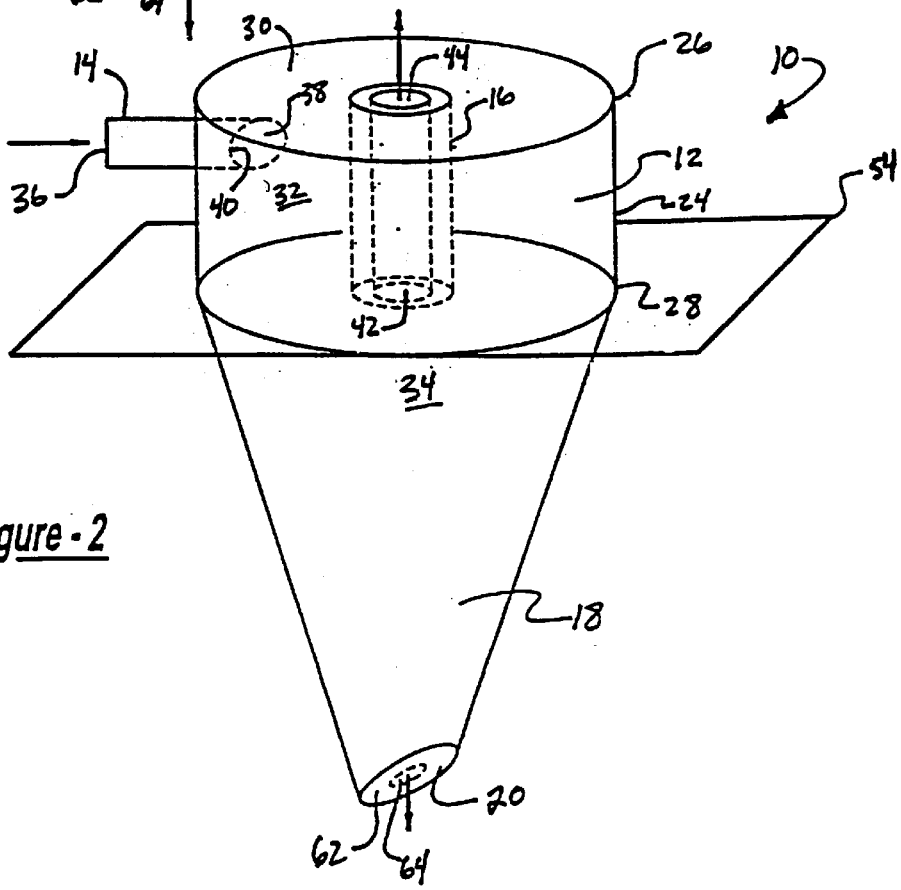
FIG. 2 is a schematic of a first alternate embodiment of an oil separator in accordance with the present invention. The figure highlights a plane that encompasses components of the oil separator.
Figure 3:
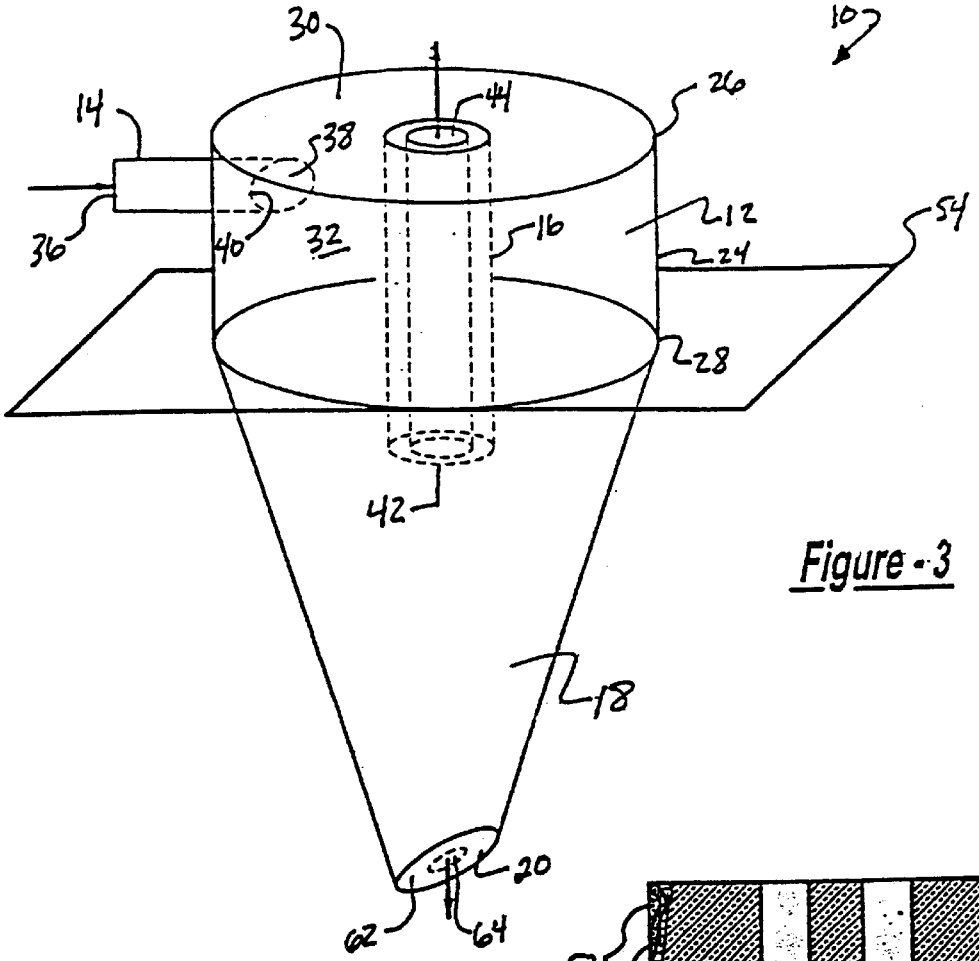
FIG. 3 is a schematic of a second alternate embodiment of an oil separator in accordance with the present invention. The figure highlights a plane that encompasses components of the oil separator.

FIGS. 1, 2, and 3 illustrate exemplary embodiments of the oil separator of the present invention. The present invention provides an oil separator, generally indicated in the figures at reference 10. The oil separator comprises a cylindrical portion 12, an inlet passage 14 tangentially connected to the cylindrical portion 12, a first outlet passage 16, a lower portion 18, and a second outlet passage 20. Generally, a mist containing oil suspended in a gaseous medium is discharged by a compressor and enters the oil separator 10 through the inlet passage 14. Upon entry at a sufficient flow rate, the mist begins to swirl downward in the cylindrical portion 12 of the oil separator 10. The swirling creates a centrifugal force on the mist, forcing the heavier oil droplets onto the inner surface of the cylindrical portion 12, thereby separating the oil from the refrigerant. The gaseous refrigerant is able to escape by passing through the first outlet passage 16. As the mixture continues downward within the oil separator 10, it enters the lower portion 18, where a decreasing cross-sectional diameter 22 increases the velocity of the swirl, thereby increasing the centrifugal force. The separated oil eventually exits the oil separator 10 through the second outlet passage 20.

The cylindrical portion 12 has a circumferential wall 24 and two ends 24, 26. The first end 26 faces the exterior of the oil separator 10 and the second end 26 faces the lower portion 18. An upper wall 30 closes the first end 26 of the cylindrical portion 12. The second end 28 is preferred open. Thus, the cylindrical portion 12 defines an open interior cavity 32. As will be developed more fully below, the lower portion 18 is in communication with the cavity 32 of the cylindrical portion 12. Thus, the entire oil separator 10 preferably defines a main interior chamber 34 that comprises the cavity 32 of the cylindrical portion 12 and the interior of the lower portion 18.

The inlet passage 14 is adapted to communicate with a compressor and the cavity 52 of the cylindrical portion 12. Preferably, the inlet passage 14 comprises a tubular member having an entry 36, an exit 38, and an interior passageway 40. The entry 36 is in communication with the compressor, and the exit 38 provides the through opening by which the inlet passage 14 enters the cylindrical portion 12. The tangential connection of the inlet passage 14 with the cylindrical portion 12 allows the mixture of oil and refrigerant to swirl upon entry into the cavity 32 of the cylindrical portion 12. Preferably, the inlet passage 14 traverses the circumferential wall 24 of the cylindrical portion 12 near the upper wall 30, thereby increasing the surface of the circumferential wall 24 available for swirling. Alternatively, the inlet passage 14 can traverse the circumferential wall 24 at any point along its height.

The first outlet passage 16 allows the refrigerant to escape the oil separator 10. The first outlet passage 16 is disposed within the oil separator 10 and is in communication with both the interior chamber 34 of the oil separator 10 and the exterior of the oil separator 10. Thus, the first outlet passage 16 has inner 42 and outer 44 openings. The inner opening 42 allows communication with the interior chamber 34 of the oil separator 10, and the outer opening 44 allows communication with the exterior of the oil separator 10. Similar to the inlet passage 14, the first outlet passage 16 is preferably a tubular shaped member.

The first outlet passage 16 extends from the upper wall 30 into the interior chamber 34 of the oil separator 10. Preferably, the first outlet passage 16 extends coaxially with the axis of the cylindrical portion 12. Alternatively, the first outlet passage 16 can be positioned at an angle to the axis. The outer opening 44 of the first outlet passage 16 is preferably defined by the upper wall 30 of the cylindrical portion 12.

Figure 4:
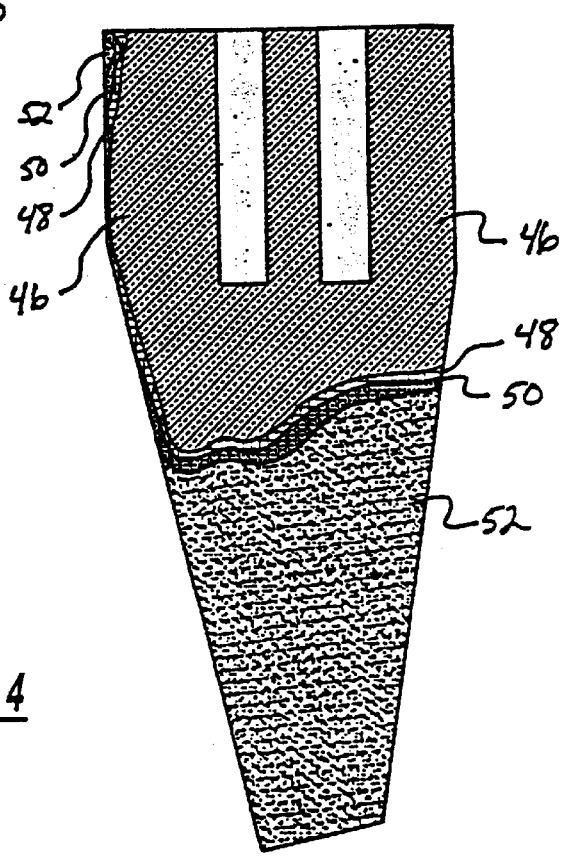
FIG. 4 is a schematic representation of data representing contours of oil concentration on the interior surface of an oil separator in accordance with the present invention.

Due to the mode of operation of the oil separator 10 of the present invention, oil concentrates at various positions on the interior surface depending on various parameters, including the height of the cylindrical portion 12 and the shape and form of the lower portion 18. FIG. 4 illustrates results of two phase modeling based on computational fluid dynamics using the physical properties of refrigerant, oil and one embodiment of the invention. As shown in FIG. 4, the modeling study predicts four primary separation regions. A first region 46 contains approximately 0% oil on the interior surface of the oil separator 10. A second region 48 contains between 0% and 25% oil on the interior surface. A third region 50 contains between approximately 50% oil on the interior surface. A fourth region 52 contains approximately 100% oil on the interior surface. The position of the inner opening 42 of the first outlet passage 16 can be in various locations, and can be optimized within the oil separator 10 to ensure that pure or nearly pure refrigerant escapes through the first outlet passage 16. This optimization is based upon the areas within the oil separator 10 at which the oil concentrates. In a preferred embodiment, shown in FIG. 1, the inner opening 42 is positioned within the cylindrical portion 12. In a first alternate embodiment, as shown in FIG. 2, the inner opening 42 can be located on a plane 54 defined by the second end 28 of the cylindrical portion 12. In a second alternative embodiment, as shown in FIG. 3, the inner opening 42 can be located below this plane 54, positioned within the lower portion 18 of the oil separator 10.

The lower portion 18 of the oil separator is located below the cylindrical portion 12 relative to the inlet passage 14. The lower portion 10 defines a chamber having at least one section that decreases in diameter 22. Thus, the lower portion 18 can take on a variety of shapes, including concave, convex, bulbous, and conical forms. Preferably, the lower portion 18 comprises a conical portion. Alternatively, the lower portion 18 can comprise any shape that has at least a portion with a decreasing diameter, which allows for an increase in the velocity of the swirl within the oil separator 10. Preferably, the cross-sectional diameter 22 of the lower portion 18 decreases gradually, such as with a conical or bulbous shape, from the tope of the lower portion 18 (i.e., the region adjacent the cylindrical portion 12) to the bottom. Alternatively, the diameter 22 can decrease in a quantum manner, such as with a chamber having an interior stair-step profile. Also, a helical groove in the interior surface could be utilized. In the preferred embodiment, the conical portion 18 comprises a wide end 56 and a narrow end 58 with a taper portion 60 between the two ends 56, 58. The conical shape provides a gradually decreasing diameter 22 to the interior of the oil separator 10, thereby allowing the swirl of the mixture to increase in velocity as it travels downward in the oil separator 10. The wide end 56 of the conical portion 18 is in communication with the interior cavity 32 of the cylindrical portion 12. Thus, as illustrated in FIGS. 1, 2 and 3, the interior of the entire oil separator 10, except for the refrigerant outlet, essentially comprises a hollow interior chamber 34.

The decreasing diameter of the lower portion 18 functions to increase the velocity of the swirl within the oil separator 10. In addition to a structure having a decreasing diameter, various other elements could be utilized to accomplish this function. For example, a swirling gas or fluid within the oil separator 10, a rotating blade or propeller, or a fan disposed within the oil separator could all be employed to increase the velocity of the swirl within the oil separator 10.

The narrow end 58 of the lower portion 18 defines a second outlet passage 20. The second outlet passage 20 communicates with the exterior of the oil separator 10, and provides the means by which the oil leaves the oil separator 10. When the oil separator 10 is connected to a compressor, the second outlet passage 20 is in communication with a passageway that allows the oil to ultimately return to the compressor. Alternatively, the second outlet passage can be positioned at any point on the lower portion 18. It is preferred that the second outlet passage 20 be positioned within an area of the lower portion 18 at which a high degree of oil concentration occurs. Particularly preferred, is a second outlet passage positioned within the fourth region 52, i.e. the region predicted to have approximately 100% oil on the interior surface.

Preferably, the second outlet passage 20 comprises an annular surface 62 with a centrally located through opening 64. Also preferable, as illustrated in FIG. 1, the second outlet passage 20 lies on a plane 54 parallel to the plane defined by the second end of the cylindrical portion. Alternatively, the second outlet passage 20 can be positioned at an angle relative to this plane 54. This embodiment is illustrated in FIGS. 2 and 3. In this embodiment, the angle $\sigma$ is preferably between 1 and 90 degrees relative to the plane parallel to the plane defined by the second end of the cylindrical portion.

Also alternatively, as illustrated in FIGS. 2 and 3, the annular surface 62 can be eliminated from the second outlet passage 20. In this embodiment, the second outlet passage 20 comprises a through opening 64 defined by the wall of the lower portion 18.

The oil separator 10 of the present invention is particularly well suited for incorporation into refrigeration circuits. These circuits are well known in the art and will not be described in detail herein. Typically, such circuits include at least a compressor, a condenser, and communicative elements disposed between these two devices. A swashplate type compressor is frequently used in the refrigeration circuit of automobiles. These compressors are known in the art, and will not be described in detail herein. Typical swashplate compressors are described in the following U.S.

Patents, each of which are herein incorporated by reference in their entirety: U.S. Pat. No. 4,996,841 to Meijer et al. for a STIRLING CYCLE HEAT PUMP FOR HEATING AND/OR COOLING SYSTEMS, U.S. Pat. No. 5,816,134 to Takenaka et al. for COMPRESSOR PISTON AND PISTON TYPE COMPRESSOR, and U.S. Pat. No. 5,921,756 to Matsuda et al. for a SWASHPLATE COMPRESSOR INCLUDING DOUBLE-HEADED PISTONS HAVING PISTON SECTIONS WITH DIFFERENT CROSS-SECTIONAL AREAS.

Figure 5:
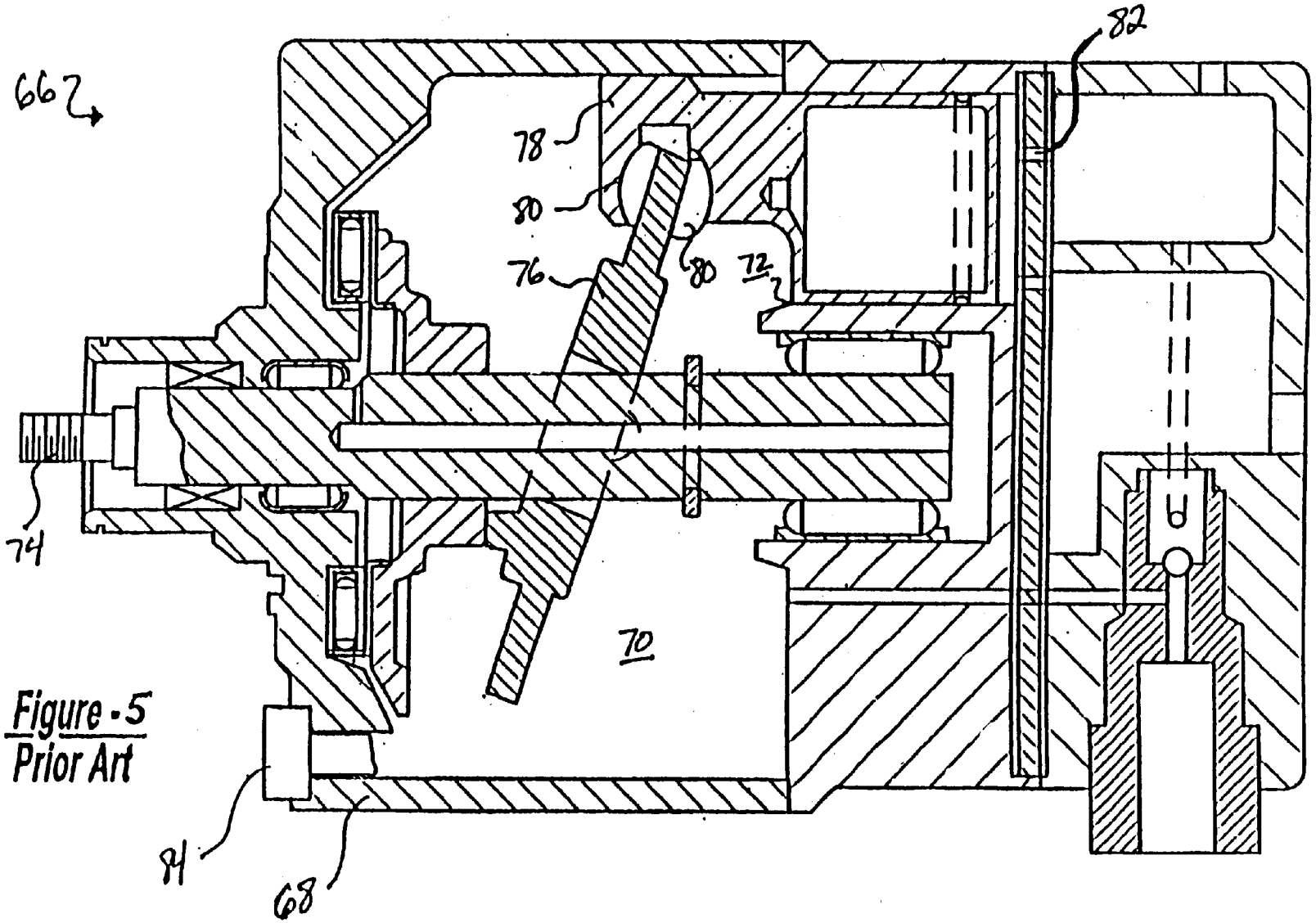
Figure-5 Prior Art
FIG. 5 is a perspective view of an exemplary prior art swashplate type compressor.

FIG. 5 illustrates a typical swashplate type compressor 66. Briefly, a swashplate type compressor 66 comprises a housing 68 that defines a swashplate chamber 70 and at least one cylinder bore 72. A rotatable driveshaft 74 passes through the housing 68 and into the swashplate chamber 70. The swashplate 76 is fixedly attached to the end of the shaft 74 at an angle within the chamber 70. A piston 78 is positioned in the cylinder bore 72 and, via shoes 80, is operably connected to the swashplate 76 such that the rotational movement of the shaft 74 and connected swashplate 76 forces the piston 78 to reciprocate in a linear fashion within the cylinder bore 72. This reciprocating movement of the piston 78 results in the compression of gas contained within the cylinder bore 72 as the piston 78 moves between a top dead center position and bottom dead center position. A discharge outlet 82 is in communication with the cylinder 72 such that the compressed gas is forced into the discharge outlet 82 and can be moved into the remainder of a refrigeration circuit. Also, the compressor 66 includes an oil return inlet 84 for returning lubricating oil to the swashplate chamber 70 such that it is available for lubricating the moving parts located within the swashplate chamber 70.

The oil separator 10 of the present invention can easily be incorporated into a swashplate type compressor 66 by placing the inlet passage 14 in communication with the discharge outlet 82 and the second outlet passage 20 in communication with the oil return inlet 84. Also, the first outlet passage 16 can be connected to the remainder of the refrigeration circuit such that the refrigerant, after being separated from the oil, can be moved into the remainder of the circuit. In this fashion, a mist containing oil suspended in a gaseous refrigerant leaves the compressor 66 through the discharge outlet 82 and enters the oil separator 10 through the inlet passage 14 at a flow rate sufficient to enable swirling within the oil separator 10. While in the oil separator 10, a swirl and resultant centrifugal force are created and the oil is gradually separated from the refrigerant. The refrigerant leaves the oil separator 10 through the first outlet passage 16 and is able to travel through the rest of the refrigeration circuit. The oil gradually leaves the oil separator 10 through the second outlet passage 20, and returns to the compressor 66 through the oil return inlet 84.

The oil separator 10 of the present invention can be formed by standard techniques, such as stamping and welding, and secured to the compressor 66 with connections being made to the inlet passage 14, first outlet passage 16 and second outlet passage 20.

Figure 6:
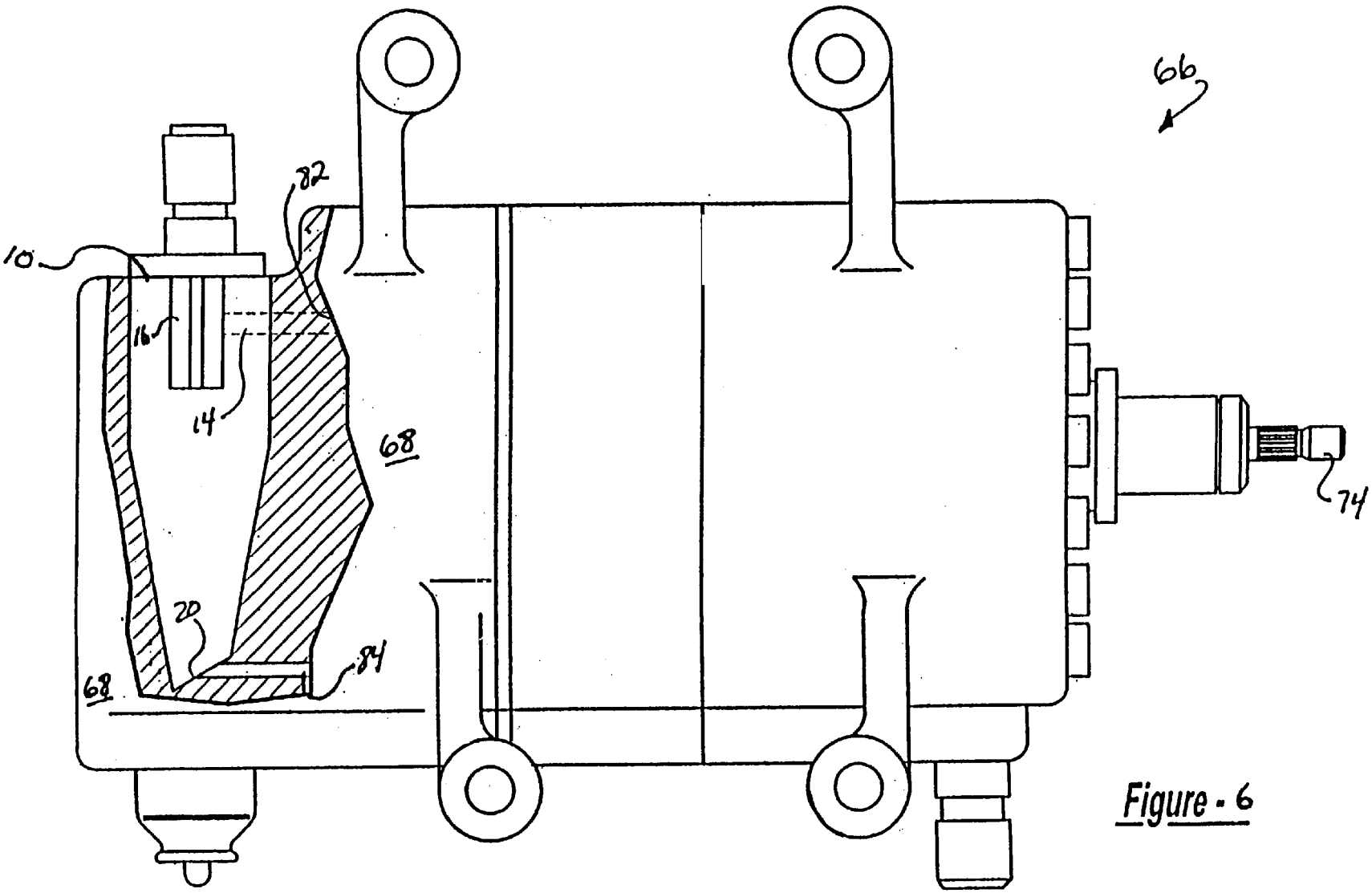
FIG. 6 is a perspective view of a swashplate type compressor that includes an oil separator in accordance with the present invention.

Preferably, however, the oil separator 10 of the present invention is integrally formed by the compressor housing 68. In this embodiment, as illustrated in FIG. 6, the oil separator 10 is machined into the housing 68 of the compressor 66. The communicative passageways between the compressor 66 and the inlet 14, first outlet 16 and second outlet 20 passages can also be integrally formed by the housing 68. Alternatively, these communicative passageways 14, 16, 20 can comprise separately attached members. The components of the oil compressor can be fabricated from steel, aluminum, or any other suitable metal or material.

The foregoing disclosure is the best mode devised by the inventors for practicing the invention. It is apparent, however, that several variations in oil separators in accordance with the present invention may be conceivable by one skilled in the art. Inasmuch as the foregoing disclosure is intended to enable one skilled in the pertinent art to practice the instant invention, it should not be construed to be limited thereby, but should be construed to include such aforementioned variations. As such, the present invention should be limited only by the spirit and scope of the following claims.

We claim:

1. An oil separator for use in a refrigeration circuit that includes a compressor capable of discharging lubricating oil suspended in a gaseous medium, said oil separator comprising:

a cylindrical portion having first and second ends and an axis, and defining an interior cavity, the first end being closed by an upper wall and the second end being open;

an inlet passage adapted to communicate with said compressor and the interior cavity of the cylindrical portion, the inlet passage being tangentially connected to the cylindrical portion;

a first outlet passage disposed within the interior cavity of the cylindrical portion and having inner and outer openings, the inner opening being in communication with the interior cavity and positioned on a plane defined by the second end of the cylindrical portion, the outer opening adapted to communicate with the remainder of said refrigeration circuit; and means for increasing a centrifugal force exerted upon said lubricating oil suspended in a gaseous medium that has entered said oil separator through the inlet passage; and a second outlet passage adapted to communicate with an oil return passage of said compressor;

wherein the means for increasing a centrifugal force are adapted such that said lubricating oil suspended in a gaseous medium entering through the inlet passage at a sufficient flow rate swirls within said oil separator and said lubricating oil separates from said gaseous medium due to centrifugal forces.

2. An oil separator according to claim 1, wherein the means for forming a first outlet passage extends coaxially with the axis of the cylindrical portion from the upper wall into the cavity.

3. An oil separator according to claim 1, wherein the means for increasing a centrifugal force comprise a lower portion having upper and lower ends, the upper end being in communication with the second end of the cylindrical portion and the cross-sectional diameter of the lower portion decreasing from the upper end to the lower end.

4. An oil separator according to claim 3, wherein the lower end comprises a conical portion having a wide end and a narrow end, the wide end being in communication with the second end of the cylindrical portion.

5. An oil separator according to claim 4, wherein the narrow end defines the means for forming a second outlet passage communicating with the exterior of said oil separator.

6. A refrigeration circuit, comprising:

a reciprocating piston compressor discharging lubricating oil suspended in a gaseous medium, said compressor comprising a housing defining a swashplate chamber and at least one axially extending cylinder bore, a rotatable shaft supported by the housing and having an axis and first and second ends, the first end being external to the housing and the second end being disposed within the swashplate chamber, a swashplate disposed on the second end of the shaft and within the swashplate chamber, the swashplate being fixedly mounted to the shaft at an angle to the axis of the rotatable shaft, a piston disposed in the cylinder bore operably connected to the swashplate such that the rotational movement of the shaft and connected swashplate is transformed to linear reciprocating movement of the piston within the chamber, a discharge outlet in communication with the cylinder bore such that compressed gas within the cylinder bore produced by the reciprocating movement of the piston is forced into the discharge outlet, an oil return inlet for returning lubricating oil to the swashplate chamber of said compressor;

a condenser;

an oil separator comprising a cylindrical portion having first and second ends and defining an interior cavity, the first end being closed by an upper wall and the second end being open, an inlet passage in communication with the discharge outlet and the interior cavity of the cylindrical portion, the inlet passage being tangentially connected to the cylindrical portion, a first outlet passage disposed within the interior cavity of the cylindrical portion and having inner and outer openings, the inner opening being in communication with the interior cavity and positioned on a plane defined by the second end of the cylindrical portion, the outer opening being in communication with the remainder of said refrigeration circuit, a lower portion having upper and lower ends, the upper end being in communication with the interior cavity of the cylindrical portion and the cross-sectional diameter of the lower portion decreasing from the upper end to the lower end, and a second outlet passage adapted to communicate with the lower portion and the oil return inlet of the compressor;

wherein the cylindrical portion and the lower portion are adapted such that the lubricating oil suspended in a gaseous medium entering the oil separator through the inlet passage at a sufficient flow rate swirls about the cylindrical portion and the lower portion and said lubricating oil separates from said gaseous medium due to centrifugal forces.

7. A refrigeration circuit according to claim 6, wherein the lower portion comprises a conical portion having a wide end and a narrow end, the wide end being in communication with the second end of the cylindrical portion.

8. A refrigeration circuit according to claim 6, wherein the housing of the compressor integrally forms the cylindrical portion and lower portion of the oil separator.

* * * * *